US007478644B2

(12) United States Patent
Zeigler

(10) Patent No.: US 7,478,644 B2
(45) Date of Patent: Jan. 20, 2009

(54) FOLDING FRAME ASSEMBLY WITH FOLDABLE LEG ARRANGEMENT

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 0 days.

(21) Appl. No.: 11/458,452

(22) Filed: Jul. 19, 2006

(65) Prior Publication Data

US 2008/0017234 A1 Jan. 24, 2008

(51) Int. Cl.
*E04H 15/50* (2006.01)

(52) U.S. Cl. ..... 135/145; 135/121

(58) Field of Classification Search ..... 135/114, 135/122, 128, 131, 143, 144, 145, 146, 151, 135/152, 157, 159, 126, 130, 139, 147; 52/82, 52/83, 80.2, 81.1, 81.3

See application file for complete search history.

(56) References Cited

U.S. PATENT DOCUMENTS 2,693,195 A * 11/1954 Frieder et al. ..... 135/122
3,968,808 A 7/1976 Zeigler
4,026,313 A 5/1977 Zeigler
4,280,521 A 7/1981 Zeigler
4,290,244 A 9/1981 Zeigler
4,334,660 A 6/1982 Zeigler
4,437,275 A 3/1984 Zeigler
4,473,986 A 10/1984 Zeigler
4,512,097 A 4/1985 Zeigler
4,522,008 A 6/1985 Zeigler
4,561,618 A 12/1985 Zeigler
4,579,066 A 4/1986 Zeigler
4,607,656 A * 8/1986 Carter ..... 135/145
4,637,180 A 1/1987 Zeigler
4,689,932 A 9/1987 Zeigler
4,747,239 A 5/1988 Zeigler
4,761,929 A 8/1988 Zeigler
4,800,663 A 1/1989 Zeigler
4,809,471 A * 3/1989 Wichman et al. ..... 52/109
4,838,003 A 6/1989 Zeigler
4,970,841 A 11/1990 Zeigler
5,016,418 A * 5/1991 Rhodes et al. ..... 52/646
RE33,710 E 10/1991 Zeigler
5,230,196 A 7/1993 Zeigler (Continued)

*Primary Examiner*—David Dunn
*Assistant Examiner*—Patrick Lynch
(74) *Attorney, Agent, or Firm*—WRB-IP LLP

(57) ABSTRACT

A folding frame assembly includes a folding frame including a plurality of pairs of struts connected end-to-end by a plurality of hub assemblies. Struts of each strut pair are pivotably connected at ends thereof to first and second ends of a hub assembly and are foldable relative to each other between a closed position in which the struts are substantially parallel to each other, the first ends of the hub assemblies are all substantially adjacent, and the second ends of the hub assemblies are all substantially adjacent, and an open position in which the struts define non-zero angles with each other, ends of the struts of each strut pair are separated from each other by the hub assemblies, and first and second ends of the hub assemblies are non-adjacent. The folding frame assembly also comprises a leg comprising two elongated members, a portion of each elongated member being fixed to the first end of the hub assembly and each elongated member being slidably mounted relative to the second end of the hub assembly.

10 Claims, 7 Drawing Sheets

U.S. PATENT DOCUMENTS 5,274,980 A 1/1994 Zeigler
5,444,946 A 8/1995 Zeigler
5,450,703 A * 9/1995 Fuhrman et al. ..... 52/843
5,651,228 A 7/1997 Zeigler
6,141,934 A 11/2000 Zeigler
6,173,726 B1 * 1/2001 Talmadge ..... 135/144
6,283,136 B1 * 9/2001 Chen ..... 135/144
6,708,707 B2 * 3/2004 Dotterweich et al. ..... 135/131
6,923,195 B2 * 8/2005 Tseng ..... 135/122
2004/0250847 A1 * 12/2004 Chiang ..... 135/131

* cited by examiner

FIG. 2A
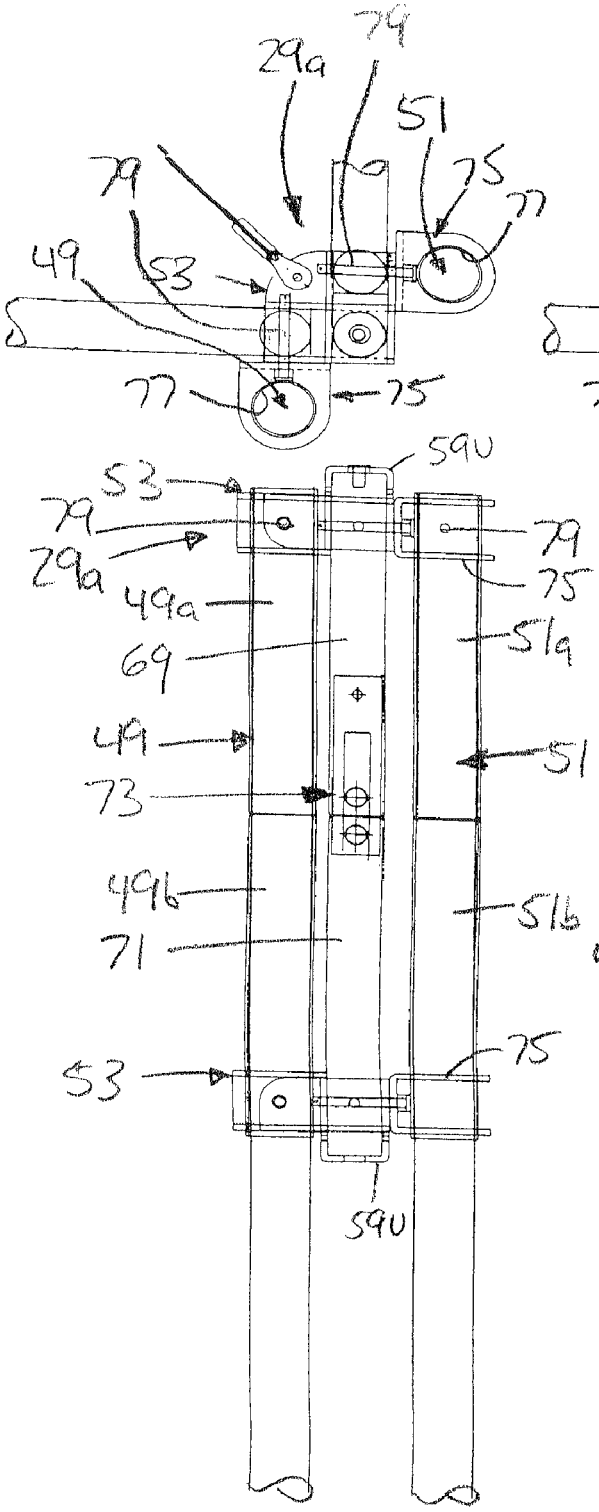
FIG. 2B
FIG. 3A
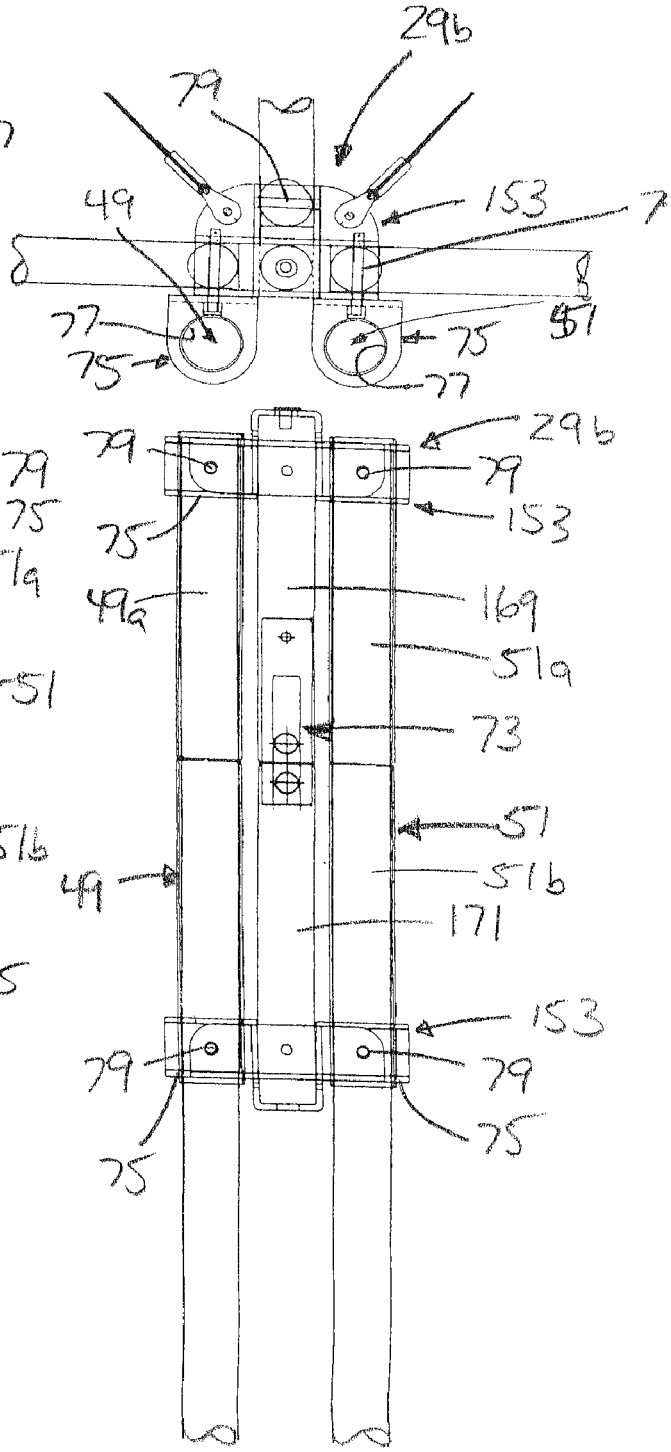
FIG. 3B

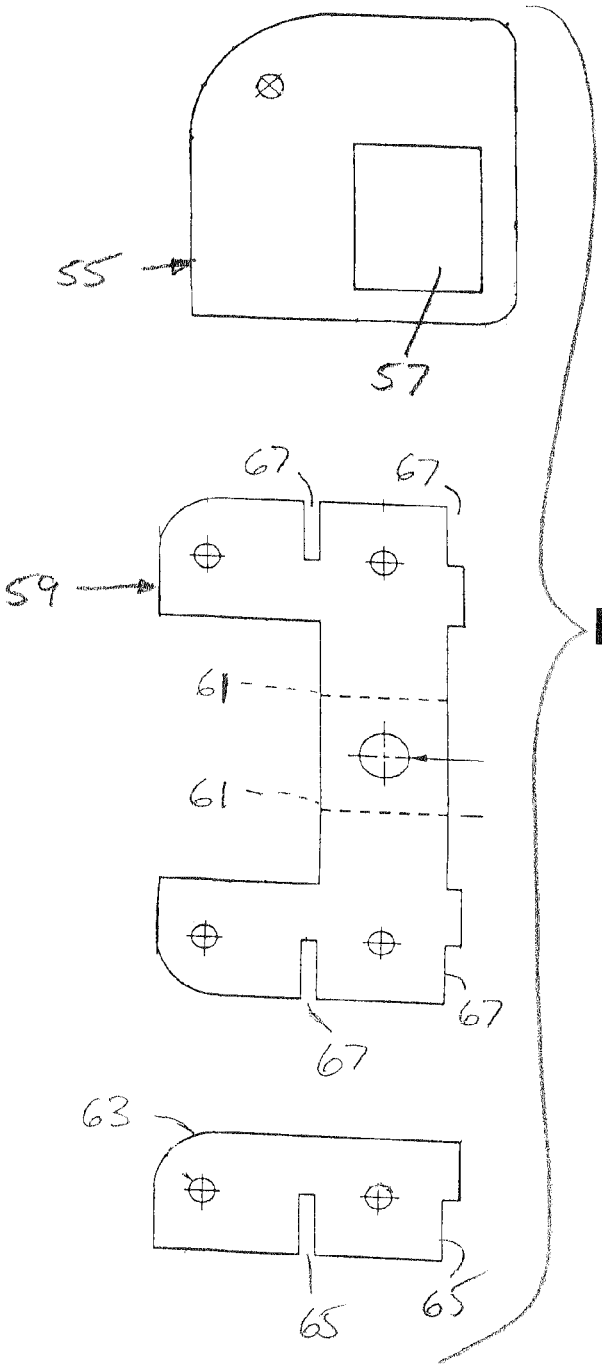
FIG. 4C
FIG. 4A
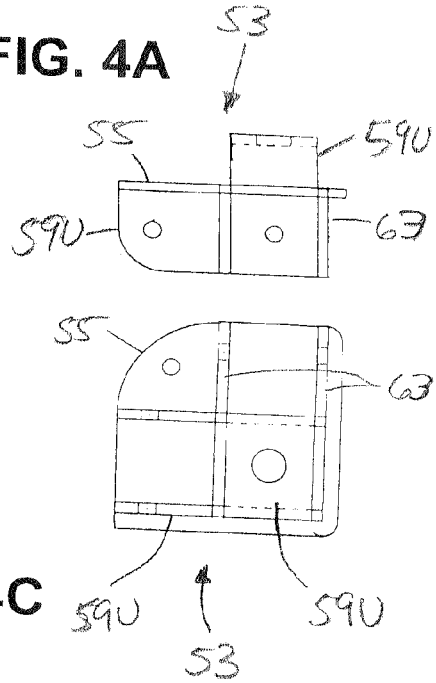
FIG. 4B

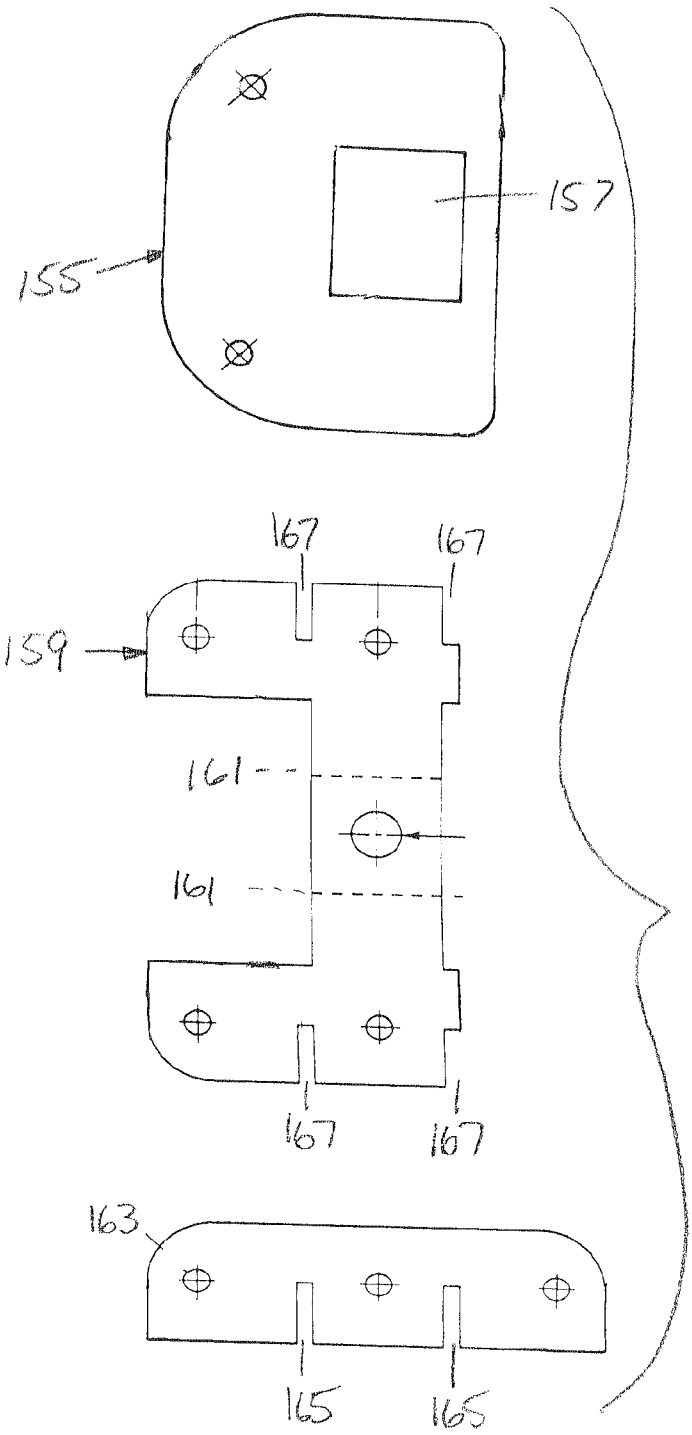
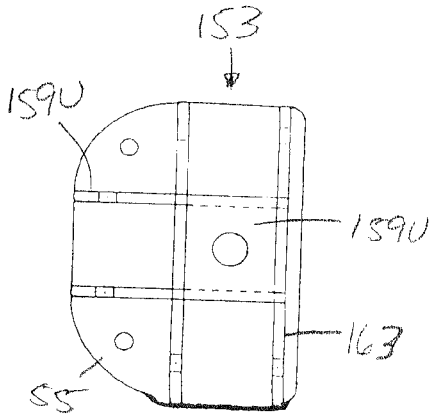
FIG. 5B
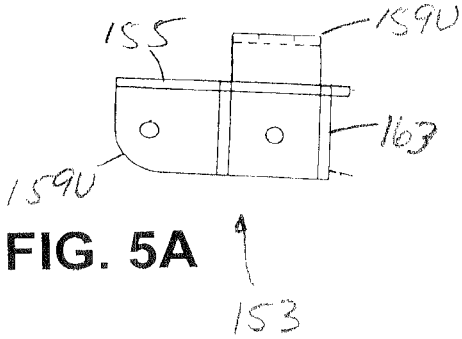
FIG. 5A
FIG. 5C

FOLDING FRAME ASSEMBLY WITH FOLDABLE LEG ARRANGEMENT

BACKGROUND AND SUMMARY

The present invention relates to folding frame assemblies and, more particularly, to folding frame assemblies with foldable leg arrangements.

Folding frame assemblies are often useful to provide mobile shelters, such as for emergency housing, special events (e.g., outdoor weddings, etc.), and the like. For many such shelters, it is desirable to minimize the space taken up by supporting columns or walls. Typical "event" shelters, for example, have legs at corners and, in some cases, along side edges. The legs are usually in the form of poles to which a folding frame system is attachable. It is desirable to provide a sturdy leg arrangement for a folding frame assembly that is adapted to be folded with the folding frame assembly.

According to an aspect of the present invention, a folding frame assembly comprises a folding frame comprising a plurality of pairs of struts connected end-to-end by a plurality of hub assemblies, struts of each strut pair being pivotably connected at ends thereof to first and second ends of a hub assembly and being foldable relative to each other between a closed position in which the struts are substantially parallel to each other, the first ends of the hub assemblies are all substantially adjacent, and the second ends of the hub assemblies are all substantially adjacent, and an open position in which the struts define non-zero angles with each other, ends of the struts of each strut pair are separated from each other by the hub assemblies, and first and second ends of the hub assemblies are non-adjacent. The folding frame assembly also comprises a leg comprising two elongated members, a portion of each elongated member being fixed to the first end of the hub assembly and each elongated member being slidably mounted relative to the second end of the hub assembly.

According to another aspect of the present invention, a folding frame assembly, comprises a folding frame comprising a first hub element having a first and a second end, and at least a pair of strut assemblies pivotably attached to the first hub element, each strut assembly comprising a second hub element having a first end and a second end, a first strut pivotably attached at a first end and a second end to the first ends of the first hub element and the second hub element, respectively, a second strut pivotably attached at a first end and a second end to the second ends of the first hub element and the second hub element, respectively, and a diagonal member extending between the first end of the first hub element and the second end of the second hub element, wherein the first and second struts are pivotable relative to the first and second hub elements between a closed position in which the first and second struts and the first and second hub elements are substantially parallel and the diagonal member has a first length and an open position in which the first and second struts define non-zero angles with the first and second hub elements and the diagonal member has a second length shorter than the first length. The folding frame assembly also comprises a leg comprising two elongated members each fixed to the first and the second end of one of the first and second hub elements.

BRIEF DESCRIPTION OF THE DRAWINGS

The features and advantages of the present invention are well understood by reading the following detailed description in conjunction with the drawings in which like numerals indicate similar elements and in which:

FIGS. 2A-2B are top and side views, respectively, of a hub assembly according to an embodiment of the present invention;

FIGS. 3A-3B are top and side views, respectively, of a hub assembly according to another embodiment of the present invention;

FIGS. 4A-4B are side and top views, respectively, of a hub according to an embodiment of the present invention, and FIG. 4C shows components for forming the hub of FIGS. 4A-4B;

FIGS. 5A-5B are side and top views, respectively, of a hub according to an embodiment of the present invention, and FIG. 5C shows components for forming the hub of FIGS. 5A-5B;

DETAILED DESCRIPTION

Figures 1A, 1B, 1C, 1D:
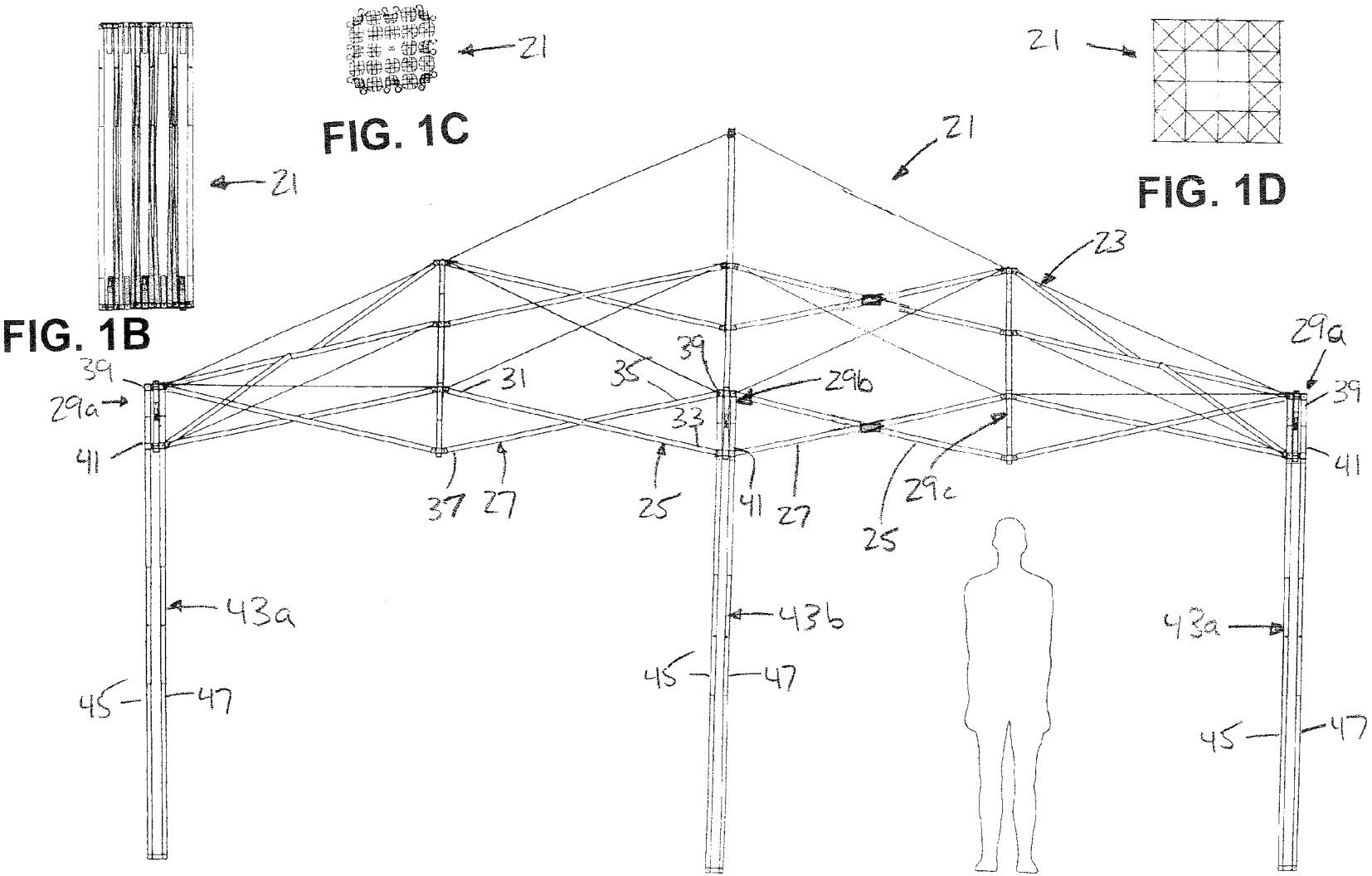
FIG. 1A is a front view of a folding frame assembly according to an embodiment of the present invention, showing the frame assembly in an open position.
FIGS. 1B and 1C are front and side views of the folding frame assembly showing the frame assembly in a closed position.
FIG. 1D is a top view of the folding frame assembly in an open position.

A folding frame assembly 21 according to an embodiment of the present invention is shown in FIGS. 1A-1D. The folding frame assembly 21 comprises a folding frame 23, which may be of any general type, such as of the type shown in my U.S. Pat. Nos. 5,230,196, 5,444,946, and 6,141,934, and in my U.S. patent application Ser. No. 10/779,641, filed Feb. 18, 2004, entitled "Expandable and Collapsible Structures Including Split Scissor Assembly", all of which are incorporated by reference.

Folding frames 23 of this general type comprise a plurality of pairs of struts 25 and 27 connected end-to-end by a plurality of hub assemblies 29. Struts of each strut pair 25 and 27 are pivotably connected at first and second ends 31 and 33, and 35 and 37 thereof to first and second ends 39 and 41 of a hub assembly 29*a* (FIGS. 2A-2B and 4A-4C), 29*b* (FIGS. 3A-3B and 5A-5C), or 29*c*. The struts 25 and 27 of each strut pair are foldable relative to each other between a closed position (FIGS. 1B-1C) in which the struts are substantially parallel to each other, the first ends 39 of the hub assemblies 29*a*, 29*b*, 29*c* are all substantially adjacent, and the second ends 41 of the hub assemblies are all substantially adjacent, and an open position (FIGS. 1A and 1D) in which the struts define non-zero angles with each other, ends of the struts of each strut pair are separated from each other by the hub assemblies, and first and second ends of the hub assemblies are non-adjacent.

The folding frame assembly 21 also comprises leg 43*a* and 43*b* comprising two elongated members 45 and 47. As seen in FIGS. 2B and 3B, a first portion 49 and 51 of each elongated member 45 and 47, respectively, is fixed to the first end 39 of the hub assembly 29*a* and 29*b*. Additionally, each elongated member 45 and 47 is slidably mounted relative to the second end 41 of the hub assembly 29*a* and 29*b*.

In the embodiment of FIGS. 1A-1D, different types of hub assemblies are typically used. In one form of hub assembly 29*a*, an example of which is shown in FIGS. 2A-2B, that is typically used at corners of the frame assembly 21, a longitudinal axis of the hub assembly and longitudinal axes of the first and second members 45 and 47 lie substantially in a plane. In another form of hub assembly 29*b*, an example of which is shown in FIGS. 3A-3B, that is typically used along sides of the frame assembly, a longitudinal axis of the hub assembly is offset from a plane defined by longitudinal axes of the first and second members 45 and 47. A third form of hub assembly 29*c* is typically used wherever the first and second hub assemblies 29*a* and 29*b* are not used, usually along the sides and interior of the frame assembly 21, and has no leg members associated with it.

The hub assembly 29*a* includes upper and lower hubs 53 of the type seen in FIGS. 4A and 4B (a lower hub can be a substantially mirror image of the upper hub), that can be formed using components as shown in FIG. 4C. The hubs 53 can be formed from a plate 55 in which a hole 57 is provided, and a plate 59 which is bent along lines 61 to form a substantial U-shaped member 59U (FIGS. 2B and 4A-4B), a bottom of the U-shaped member being inserted through the hole 57 so that the U-shaped member is held in place relative to the plate by any suitable means, such as by a friction fit or by mechanical means such as welding, brazing, adhesive, or the like. Brackets 63 are then secured to the U-shaped member 59U, such as by causing cut-outs 65 in the brackets to align with cut-outs 67 in the U-shaped member. As seen in FIG. 2B, the hubs 53 are connected to each other by an elongated member having first and second portions 69 and 71 that can be detachably secured to each other by any suitable means. An illustrative means involves the use of a spring-loaded button arrangement 73 wherein a spring-loaded button is disposed inside one of the portions 69 and 71, the other of the portions is at least partially tubular and is disposed around part of the portion in which the button is disposed, and the button and extends through holes in the portions to secure the portions together. The button is depressed to detach the portions 69 and 71.

The hub assembly 29*b* is similar to the hub assembly 29*a* and includes upper and lower hubs 153 as seen in FIGS. 5A and 5B, that can be formed using components as shown in FIG. 5C. The hubs 153 can be formed from a plate 155 in which a hole 157 is provided, and a plate 159 which is bent along lines 161 to form a substantial U-shaped member 159U (FIGS. 3B and 5A), a bottom of the U-shaped member being inserted through the hole 157 so that the U-shaped member is held in place relative to the plate by any suitable means, such as by a friction fit or by mechanical means such as welding, brazing, adhesive, or the like. Brackets 163 are then secured to the U-shaped member 159U, such as by causing cut-outs 165 in the brackets to align with cut-outs 167 in the U-shaped member. The hubs 153 are connected to each other by an elongated member having first and second portions 169 and 171 that can be detachably secured to each other by any suitable means, such as by a spring-loaded button arrangement 73.

A first portion 49 and 51 of each elongated member 45 and 47 of the leg 43*a* and 43*b* can be fixed to the first end 39 of the hub assembly 29*a* and 29*b* by any suitable means, such as by a friction fit, welding, brazing, adhesive, etc. More particularly, the first portion 49 and 51 of the elongated members 45 and 47 of the leg 43*a* and 43*b* can comprise an upper portion 49*a* and 51*a* fixed to the first end 39 of the hub assembly 29*a* and 29*b* and a lower portion 49*b* and 51*b* slidably mounted relative to the hub assembly.

The first or upper portion 49*a* and 51*a* may be fixed in a bracket 75 (FIGS. 2A-2B and 3A-3B) having an opening 77 and the bracket can be pivotably secured to the first end 39 of the hub assembly 29*a* (or 29*b*), such as by a pin 79 that can secure the bracket as well as an end of a strut 25 or 27. The lower portion 49*b* and 51*b* can extend through a similar opening 77 in a bracket 75 secured to the second end 41 of the hub assembly 29*a* (or 29*b*) and can have a smaller diameter than the upper portion 49*a* and 51*a* so that the lower portion will be slidable in the opening. An upper part of the lower portion 49*b* and 51*b* can be received inside a lower part of the upper portion 49*a* and 51*b* and the lower portion and the upper portion can be fixed together, such as by a friction fit, welding, brazing, adhesive, etc. Other arrangements can be provided, such as embodiments wherein, instead of using the same size opening for brackets secured to the first and second ends of the hub assembly, the first portions 49 and 51 may have a constant diameter over their lengths and the opening in the brackets pivotably attached to the second end of the hub assembly and through which the first portions extend and are slidable may be larger than the openings in the brackets pivotably attached to the first end of the hub assembly and relative to which the first portions are fixed.

Figure 6A:
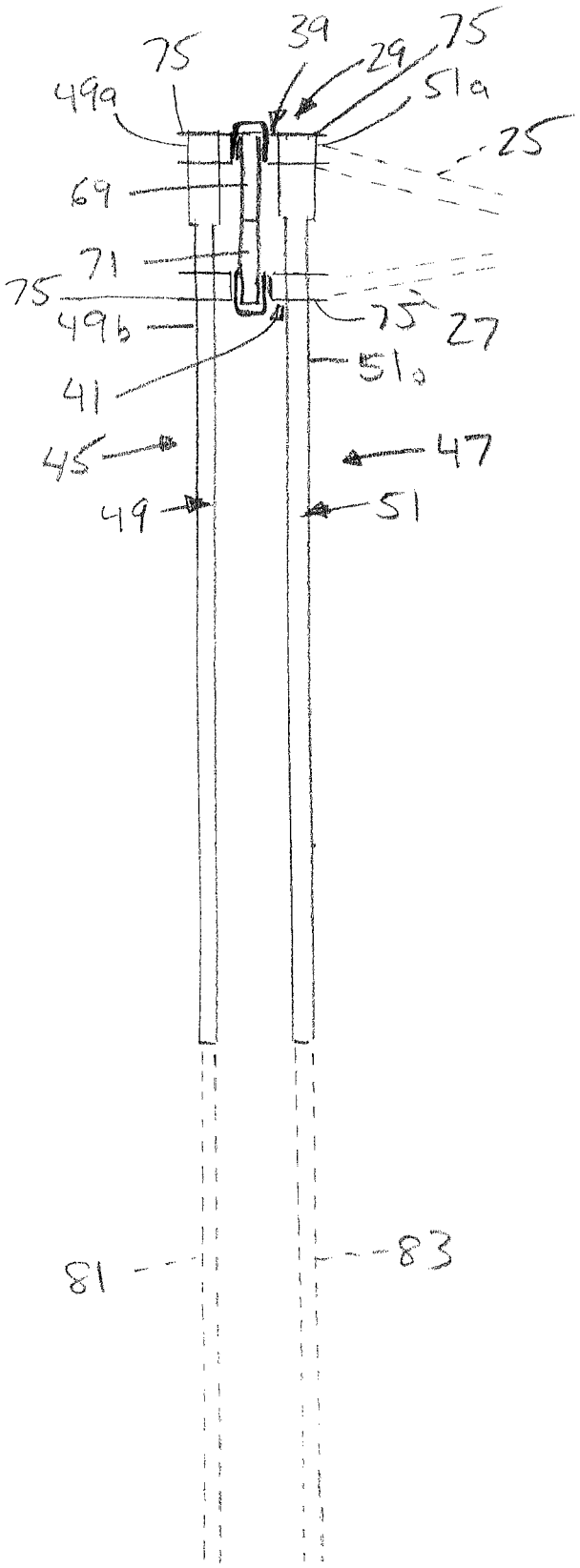
FIGS. 6A-6B are schematic side views of a leg arrangement for a folding frame assembly showing the leg arrangement in an open state and a closed state, respectively.
Figure 6B:
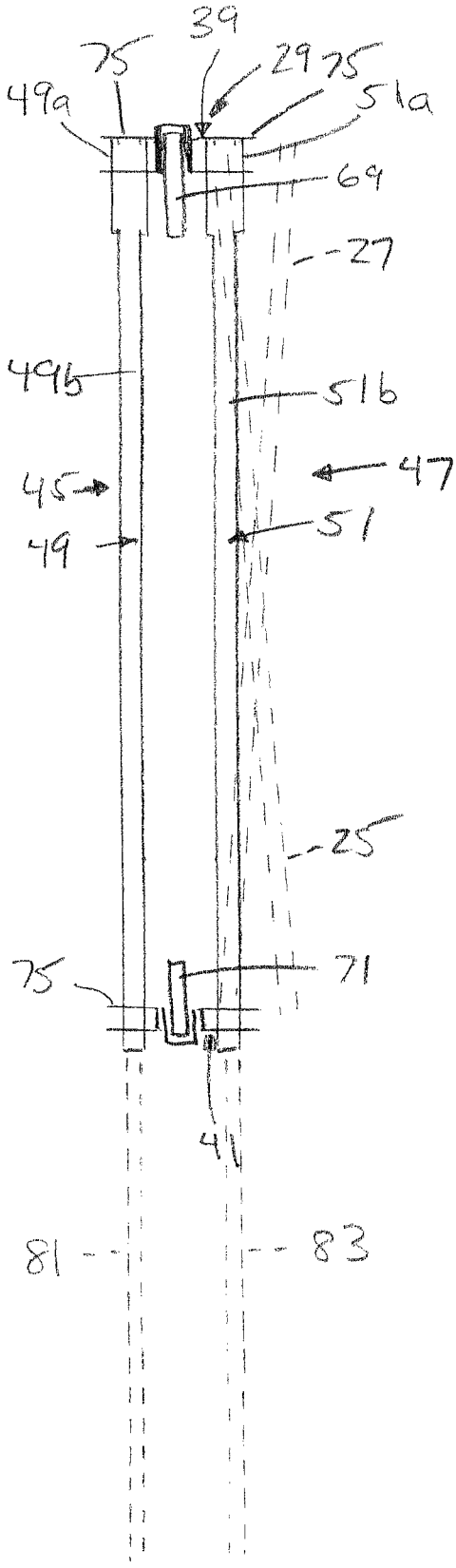
Figure 7A:
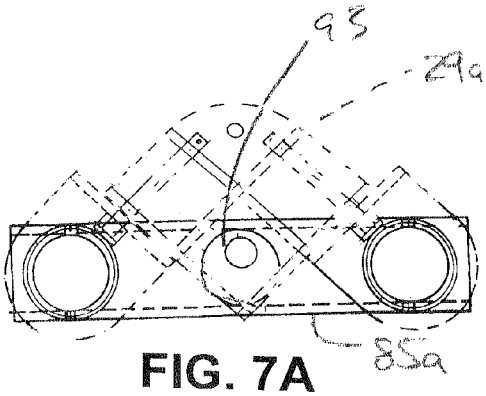
FIGS. 7A-7B are top and side views of a foot for a leg arrangement according to an embodiment of the present invention.
Figure 7C:
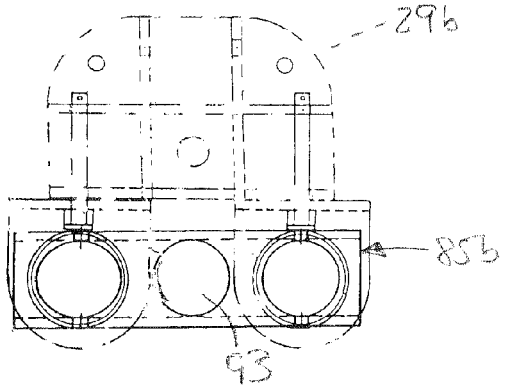
FIGS. 7C and 7D are top and side views of a foot for a leg arrangement according to another embodiment of the present invention.
Figure 7B:
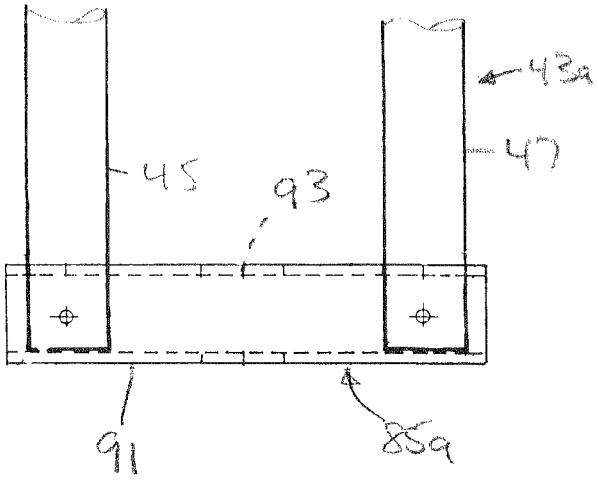
Figure 7D:
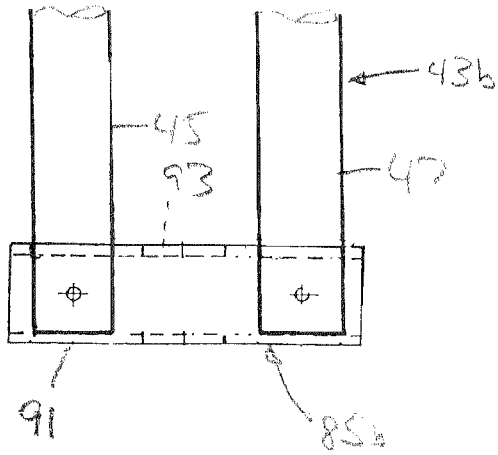

FIGS. 6A and 6B schematically show part of a frame assembly 21 folded about a leg assembly having a hub 29 from an open position (FIG. 6A) to a closed position (FIG. 6B). In the open position seen in FIG. 6A, elongated members 69 and 71 associated with the first and second ends 39 and 41 of the hub assembly 29 are attached to each other. The upper, fixed portions 49*a* and 51*a* of the elongated members 45 and 47 are attached by brackets 75 secured to the first end 39 of the hub assembly 29 and are pivotable relative to the hub assembly 29 but are not adapted to move longitudinally relative to the hub assembly. In this position, the struts 25 and 27 (shown in phantom) are substantially non-parallel to the elongated members 45 and 47. In the closed position as seen in FIG. 6B, the elongated members 69 and 71 are separated and the slidable portions 49*b* and 51*b* of the elongated members 45 and 47 slide relative to holes in brackets 75 secured to the second end 41 of the hub assembly 29, usually to a point at which the struts 25 and 27 are substantially parallel with the elongated members 45 and 47.

The elongated portions 45 and 47 of the leg 43*a* and 43*b* ordinarily comprise a second portion 81 and 83 (FIG. 1A, and shown in phantom in FIGS. 6A-6B) adapted to be received in a telescoping fashion in the first portion 49 and 51. The second portion 81 and 83 can be movable relative to the first portion between an extended position and a retracted position in which, ordinarily, the second portion will be substantially entirely received inside the first portion 49 and 51. In this way, the legs 43*a* and 43*b* can have greater lengths in the expanded or open position than the length of the struts 25 and 27 yet, when the frame system 21 is folded, the height of the folded assembly can be about the same as the length of the struts.

As seen in FIGS. 1A and 7A-D, a foot portion 85*a* and 85*b* can be attached at a bottom 87 and 89 of the leg 43*a* and 43*b*. The foot portion 85*a* and 85*b* can include a support surface 91 extending generally perpendicularly to a longitudinal axis of the leg 43*a* and 43*b* to facilitate distributing the weight of the leg so that all of the weight is not concentrated at the bottoms of the elongated members 45 and 47. The foot portion 85*a* and 85*b* can comprise an opening 93 arranged to receive a bottom end of the hub assembly 29*a* and 29*b*, such as the bottom of the "U" of the U-shaped portion 59U and 159U of the lower hub 53 and 153 when the frame is in the closed position. The opening 93 can be arranged to receive a securing member such as a stake when the frame is in the open position.

Figure 8A:
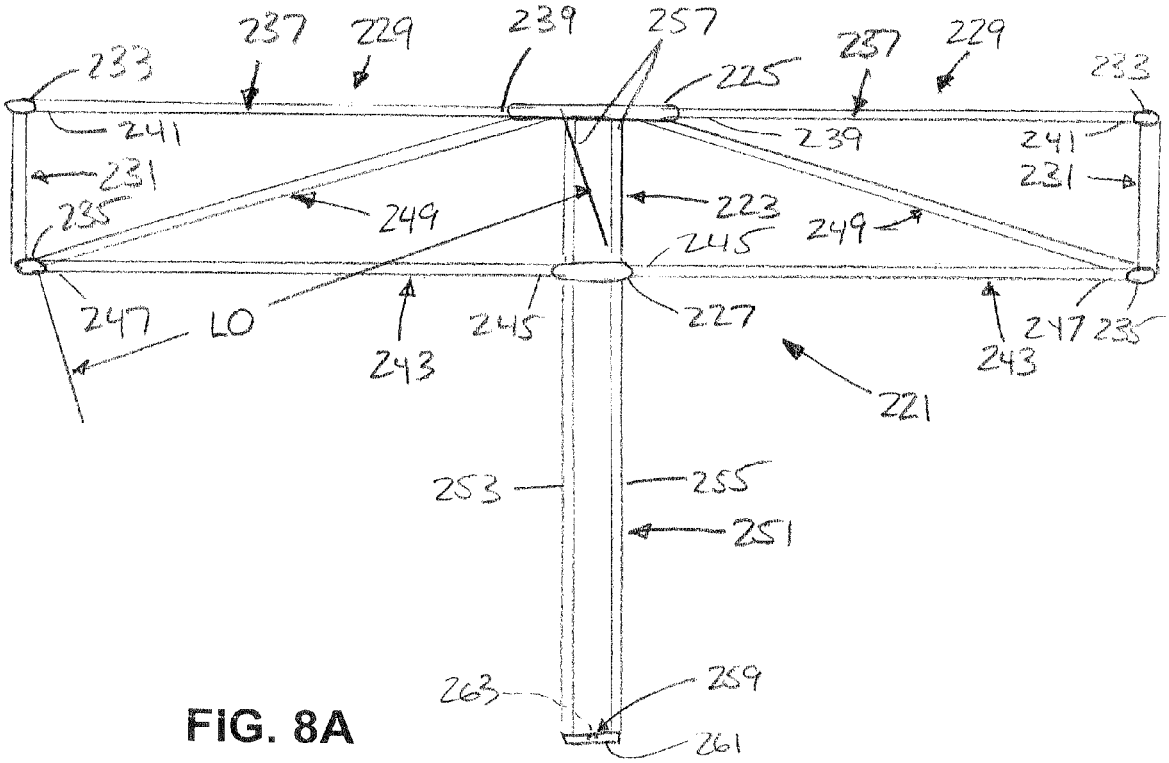
FIGS. 8A-8B are schematic side views of a leg arrangement for a folding frame assembly according to another embodiment of the present invention and showing the leg arrangement in an open state and a closed state, respectively.
Figure 8B:
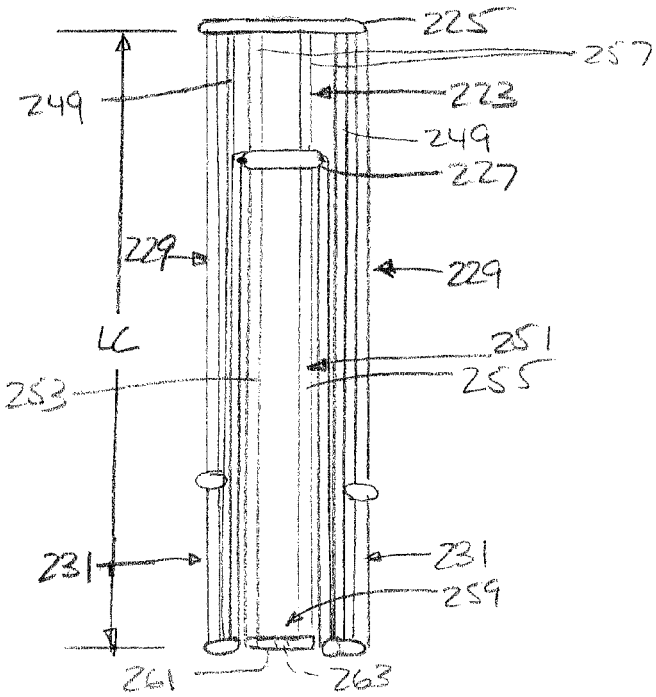

My U.S. patent application Ser. No. 11/458,447 entitled Folding Frame System with Folding Frame Elements discloses another form of folding frame system and is incorporated by reference. As seen in FIGS. 8A and 8B, a folding frame assembly 221 comprises a first hub element 223 having a first and a second end 225 and 227. The folding frame assembly 221 also comprises at least a pair of strut assemblies 229 pivotably attached to the first hub element 223. Each strut assembly 229 comprises a second hub element 231 has a first end 233 and a second end 235. Each strut assembly 229 also comprises a first strut 237 pivotably attached at a first end 239 and a second end 241 to the first ends 225 and 233 of the first hub element 223 and the second hub element 231, respectively, and a second strut 243 pivotably attached at a first end 245 and a second end 247 to the second ends 227 and 235 of the first hub element 223 and the second hub element 231, respectively. The folding frame assembly 221 also comprises a diagonal member 249 extending between the first end 225 of the first hub element 223 and the second end 235 of the second hub element 231. The first and second struts 237 and 243 are pivotable relative to the first and second hub elements 223 and 231 between a closed position (FIG. 8B) in which the first and second struts and the first and second hub elements are substantially parallel and the diagonal member 249 has a first length LC and an open position (FIG. 8A) in which the first and second struts define non-zero angles with the first and second hub elements and the diagonal member has a second length LO shorter than the first length. The diagonal member 249 is ordinarily a telescopic member that is adapted to be locked at the second length LO, such as by a spring loaded button arrangement that holds the telescoping components in position.

The folding frame assembly 221 also comprises a leg 251 comprising two elongated members 253 and 255 each fixed to the second end 227 of the first hub element 223. In the embodiment shown in FIGS. 8A-8B, the first hub element 223 is shown as comprising two elongated members 257 extending between a top or first end 225 of the first hub element 223 and a bottom or second end 227, the elongated members being aligned with the elongated members 253 and 255 of the leg 251. The elongated member between the first and second ends of the 225 and 227 of the first hub element can have other forms, such as by being a single elongated member. To facilitate folding of the frame assembly 221, the hub at the first end 225 of the first hub element 223 is ordinarily larger than the hub at the second end of the first hub element, and the hub at the second end 235 of the second hub element 231 is usually larger than the hub at the first end 233 of the second hub element. A foot portion 259 can be attached at a bottom of the leg 251. The foot portion 259 can include a support surface 261 extending generally perpendicularly to a longitudinal axis of the leg 251. As with the foot portions 85*a* and 85*b*, the foot portion 259 can comprise an opening 263 arranged to receive a stake when the frame is in the open position. The elongated members 253 and 255 can comprise telescoping sections that can be moved between a closed position in which an inner one of the sections is substantially entirely received inside of an outer one of the sections and an open position in which the inner one of the sections is substantially extended from the outer section and is locked to prevent the inner section from moving back toward the closed position, such as by a spring mounted pin arrangement.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A folding frame assembly, comprising:

a folding frame comprising a plurality of pairs of struts connected end-to-end by a plurality of hub assemblies, struts of each strut pair being pivotably connected at ends thereof to first and second ends of a hub assembly and being foldable relative to each other between a closed position in which the struts are substantially parallel to each other, the first ends of the hub assemblies are all substantially adjacent, and the second ends of the hub assemblies are all substantially adjacent, and an open position in which the struts define non-zero angles with each other, ends of the struts of each strut pair are separated from each other by the hub assemblies, and first and second ends of the hub assemblies are non-adjacent; and a leg comprising first and second elongated members, a portion of each elongated member being fixed to the first end of the hub assembly and each elongated member being slidably mounted relative to the second end of the hub assembly, the first and second elongated members being spaced relative to each other and the second end of the hub assembly being slidably between the first and second elongated members.

2. The folding frame assembly as set forth in claim 1, comprising a foot portion attached at a bottom of the leg, the foot portion including a support surface extending generally perpendicularly to a longitudinal axis of the leg.

3. The folding frame assembly as set forth in claim 2, wherein the foot portion comprises an opening arranged receive a stake when the frame is in the open position.

4. The folding frame assembly as set forth in claim 1, wherein a longitudinal axis of the hub assembly and longitudinal axes of the first and second elongated members lie substantially in a plane.

5. The folding frame assembly as set forth in claim 1, wherein a longitudinal axis of the hub assembly is offset from a plane defined by longitudinal axes of the first and second elongated members.

6. The folding frame assembly as set forth in claim 1, wherein a first portion of the leg is fixed to the first end of the hub assembly by a friction fit.

7. The folding frame assembly as set forth in claim 1, wherein a first portion of the leg comprises an upper portion fixed to the first end of the hub assembly and a lower portion slidably mounted relative to the hub assembly, the lower portion having a smaller diameter than the upper portion.

8. The folding frame assembly as set forth in claim 7, wherein part of the lower portion is received inside the upper portion and the lower portion and the upper portion are fixed together.

9. The folding frame assembly as set forth in claim 1, wherein the first and second elongated members each comprises a second portion adapted to be received in a telescoping fashion in a first portion and being movable relative to the first portion between an extended position and a retracted position.

10. The folding frame assembly as set forth in claim 9, comprising a foot portion attached at a bottom of the leg, wherein the foot portion comprises an opening arranged receive a stake when the leg is in an extended position.

* * * * *